US005421133A

United States Patent [19]

Berdan, II et al.

[11] Patent Number: 5,421,133

[45] Date of Patent: Jun. 6, 1995

[54] INSULATION BATT WITH EXTENDED FLANGE

[76] Inventors: Clarke Berdan, II, 1878 Hankinson Rd.; Roy E. Shaffer, 19 Wesleyan Cir., both of Granville, Ohio 43023; Ray G. Stout, 3573 Telegraph Dr., San Jose, Calif. 95132

[21] Appl. No.: 66,284

[22] Filed: May 20, 1993

[51] Int. Cl.[6] ..... F04B 1/74

[52] U.S. Cl. ..... 52/404.1; 52/406.1; 52/309.11; 428/157; 428/172; 156/71

[58] Field of Search ..... 52/404.1, 404.2, 404.6, 52/406.1, 406.2, 406.3, 407.2, 407.3, 407.4, 309.4, 309.11, 309.12; 428/74, 157, 172, 192; 156/71

[56] References Cited

U.S. PATENT DOCUMENTS

| | | | |
|---|---|---|---|
| 2,238,022 | 6/1941 | Johnson | 52/404.3 |
| 2,271,575 | 2/1942 | Waterman | 52/406.1 |
| 2,330,941 | 10/1943 | Acuff, Jr. | 52/407.1 |
| 2,777,318 | 1/1957 | Kinsman | 52/404.4 |
| 3,318,063 | 5/1967 | Stone et al. | 52/404.1 |
| 3,835,604 | 9/1974 | Hoffmann, Jr. | 52/404.1 |
| 4,522,004 | 6/1985 | Evans . | |
| 4,525,970 | 7/1985 | Evans . | |
| 4,557,092 | 12/1985 | Drueske | 52/404.1 |
| 4,615,162 | 10/1986 | Evans . | |
| 4,798,754 | 1/1989 | Tomek | 428/157 |
| 5,271,878 | 12/1993 | Mizia et al. | 52/309.4 |

*Primary Examiner*—Carl D. Friedman
*Assistant Examiner*—Winnie S. Yip
*Attorney, Agent, or Firm*—Ted C. Gillespie

[57] ABSTRACT

An insulation product comprises an elongated blanket of fibrous insulation material having a facing on one major surface, the facing extending beyond the edges of the blanket to form opposed flanges, the flanges having first reinforcement fibers extending longitudinally along the outer edge zones of the flanges, and the flanges having intermediate zones positioned inwardly of the outer edge zones, and provided with second reinforcement fibers of a lesser density so as to provide a visual indication of the boundary between the outer edge zones and the intermediate zones of the flanges.

21 Claims, 2 Drawing Sheets

INSULATION BATT WITH EXTENDED FLANGE

FIELD OF THE INVENTION

This invention pertains to insulation products for use in insulating the undersides of ceiling structures. More particularly, this invention relates to insulation having a facing, where the facing extends beyond the edges of the insulation to form flanges for attachment to joists of ceiling structures.

BACKGROUND ART

In some types of building construction, the underside of the ceiling of the structure is insulated to prevent the loss of heat during the heating season. Also, in warmer climates, the insulation acts as a barrier to the infiltration of heat from the area above the ceiling. The ceiling structure is generally comprised of a plurality of parallel, evenly spaced rafters and a plurality of parallel, evenly spaced purlins or joists which are positioned spanning the rafters, and at right angles to the rafters. Typically, the ceiling joists are spaced on 2 foot centers.

Although most commercial construction uses metal rafters and joists or purlins, a significant component of the construction of such buildings uses wood for the joists. Typically, the insulation product designed for warm weather climates is faced with a foil-scrim-kraft facing. This facing has the layer of foil to act as a moisture and air infiltration barrier. It also serves as the finished ceiling.

Usually, the facing is designed to be wider than the insulation batt so that the flange can be used to staple the product into place. The use of wood joists enables the construction worker to apply the insulation from below the ceiling by stapling the flanges to the wooden joists, although other means of attachment, such as by adhesive, can be used. Typically, a 24 inch wide batt will have an extra 9 inches of facing (4½ inches on each side) to provide for stapling to hold the batt in place between the joists. It is desirable in some climates to provide an R-19 insulation batt, which is nominally about 6 inches thick. In order to accommodate the typical 2×4 joist construction, the flange is designed to be wide enough to enable considerable sag of the facing material in order to enable the insulation material to fully expand to its six inch thickness.

One of the problems with typical extended flange batt products for the application to the undersides of ceiling structures is that the placement of the flange and stapling of the flange onto the joist is an imprecise craft. The typical installer never knows exactly how high to attach the flange onto the side of the joist. If the installer attaches the flange too far up on the joist, the facing is too taught, and the insulation product is compressed and not fully expanded. The resulting compressed insulation has lost some of its potential R-value. On the other hand, if the insulation installer attaches the facing too low on the joist, the facing will have too much sag, and air pathways, which provide thermal bridges for the entrance of heat will be established. This, of course, cuts down on the thermal performance of the insulation system.

The tendency during installation is for the installer to place the flange too high up on the joist in order to provide a relatively taught appearance of the bottom of the insulation product. Although this may be more aesthetically pleasing when viewed from below, it destroys some of the intended insulation value of the system.

In order to solve the problem of exact placement of the product flange on the sidewall of the joist, any mark or indication on the flange must meet several requirements, first, it must be visible from both the top and bottom side of the flange so that the installer has the flexibility of stapling on either side of the flange. Second, it is highly desirable for any such indicator to be substantially invisible to the viewer standing on the ground beneath the ceiling in order to avoid the appearance of a construction mark or blemish on the finished insulation system.

Another problem with extended flange insulation products is that when the flange is stapled to the joists, there is sometimes a tendency for the flange paper to rip or pull through the staple, with the result being that the insulation product falls to the floor. Various attempts have been made to reinforce the area in which the flange is to be stapled so that the staple passes through a reinforcement fiber, thereby securely holding the flange into place.

It would be desirable to have a system for not only reinforcing the edges of the flange for strength in stapling, but also having some means for correctly informing the installer the exact desired location for the flange on the joist.

DISCLOSURE OF THE INVENTION

There has now been invented an insulation system and insulation product in which the edge portions of the extended flange of a faced batt have a reinforcement material, such as reinforcement fibers, in outer edge zones of the flanges for receiving staples to hold the flanges against the joists. Immediately adjacent to the outer edge zones of the flanges are intermediate zones provided with a contrasting amount of reinforcement, such as a second series of reinforcement fibers which are designed merely to reinforce the facing, and not for stapling. The contrast at the boundary between the outer zones and intermediate zones provides a clear indicator for the installer. The installer lines up the boundary with the bottom corner of the joists, and thereby is able to staple the flange at the exact height required for optimum placement of the insulation product into the ceiling system.

According to this invention, there is now provided an insulation product comprising an elongated blanket of fibrous insulation material having a facing on one major surface, the facing extending beyond the longitudinal edges of opposite sides of the major surface to form opposed flanges, the flanges having a first reinforcement material extending longitudinally along the outer edge zones of the flanges, and the flanges having intermediate zones positioned inwardly of the outer edge zones, the first reinforcement material providing a contrast with the intermediate zones so as to provide a visual indication of the boundary between the outer edge zones and the intermediate zones of the flanges. By providing a clear indication where the boundary is between the outer zone and the intermediate zone of the flange area of the facing, the installer is given a means with which to accurately place the insulation product for optimum insulation value.

In a specific embodiment of the invention, the first reinforcement material is a film. The film can provide either a visual indication of the boundary on at least one side of the flange or a tactile indication of the boundary on at least one side of the flange. Preferably, the indicator is on both sides of the flange.

In the preferred embodiment of the invention, the first reinforcement material is a plurality of first reinforcement fibers. Most preferably, the intermediate zone contains second reinforcement fibers extending longitudinally, and the ratio of the density of the second reinforcement fibers in the intermediate zones (second density) to the density of the first reinforcement fibers in the outer edge zones (first density) is less than 0.5. Most preferably, the ratio is less than 0.25.

In another embodiment of the invention, the first density is within the range of from about 0 to about 2 fibers per inch. Preferably, the second density is within the range of from about 2 to about 0.5 fibers per inch.

In yet another embodiment of the invention, the facing comprises a lamination of two layers with the first reinforcement fibers being sandwiched between them, the first reinforcement fibers being sufficiently large to provide visible relief on both faces of the flanges. Preferably, the first reinforcement fibers are larger in diameter than the second reinforcement fibers, to provide further contrast at the boundary and to provide greater relief of the fibers through the facing.

According to this invention, there is also provided an insulation system comprising a series of parallel spaced apart joists and an elongated blanket of fibrous insulation material having a facing on one major surface, the facing extending beyond the longitudinal edges of opposite sides of the major surface to form opposed flanges, the flanges having first reinforcement fibers extending longitudinally along the outer edge zones of the flanges, the first reinforcement fibers having a first spacing, and the flanges having intermediate zones positioned inwardly of the outer edge zones, the intermediate zones being provided with second reinforcement fibers having a second spacing substantially greater than the first spacing in the outer edge zones so as to provide a visual indication of the boundary between the outer edge zones and the intermediate zones of the flanges, and the flanges being stapled to the joists so that the boundary is substantially in alignment with a bottom corner of the joist.

BEST MODE OF CARRYING OUT THE INVENTION

This invention will be described in terms of a glass fiber insulation product although it is to be understood that the blanket of insulation can be made of any type of mineral fibers, such as fibers from rock, slag or basalt or of any other kind of blanket-like insulation material.

Figure 1:
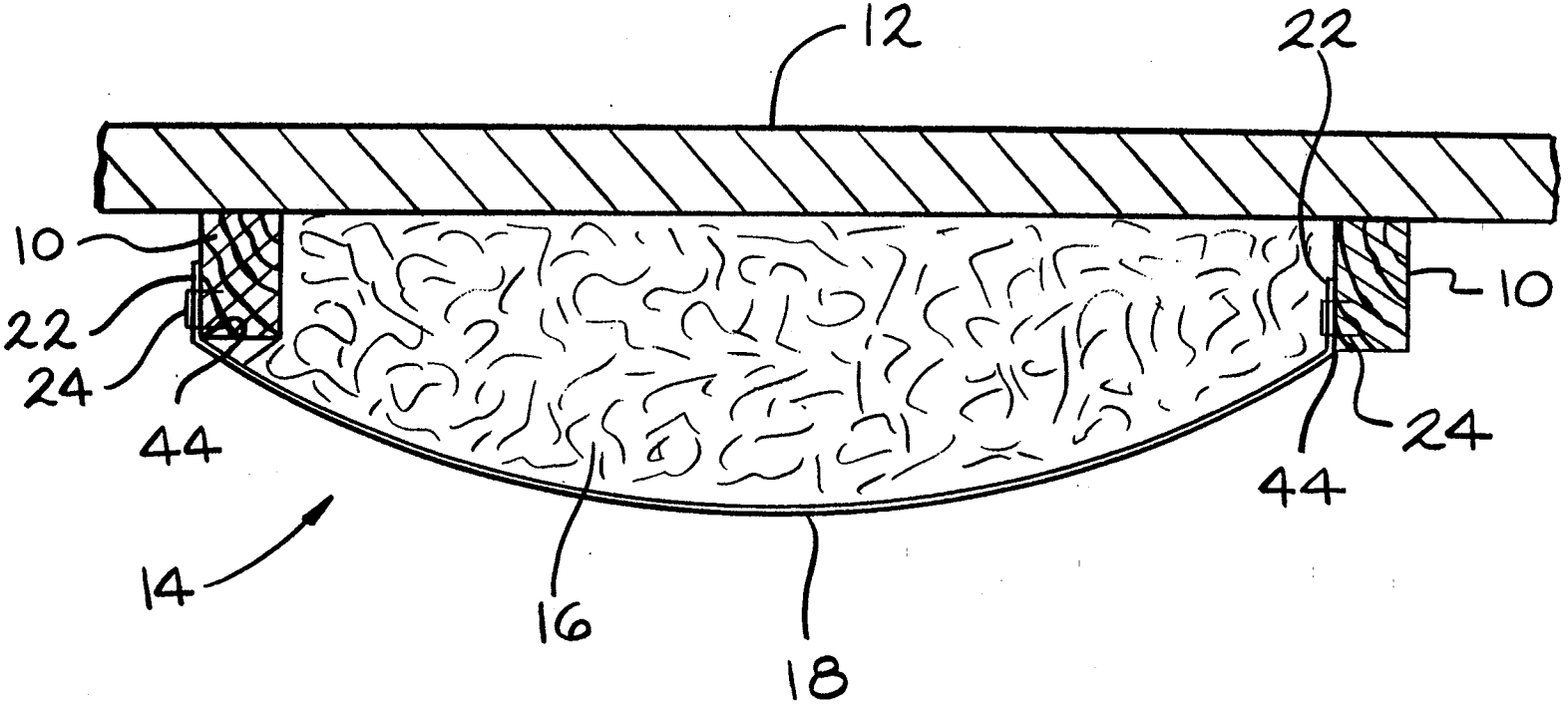
FIG. 1 is a sectional view in elevation of an insulation system according to the principles of the invention.

As shown in FIG. 1, the ceiling construction generally comprises joists 10 upon which is supported the deck 12. The joists are supported by beams or rafters, not shown.

Figure 2:
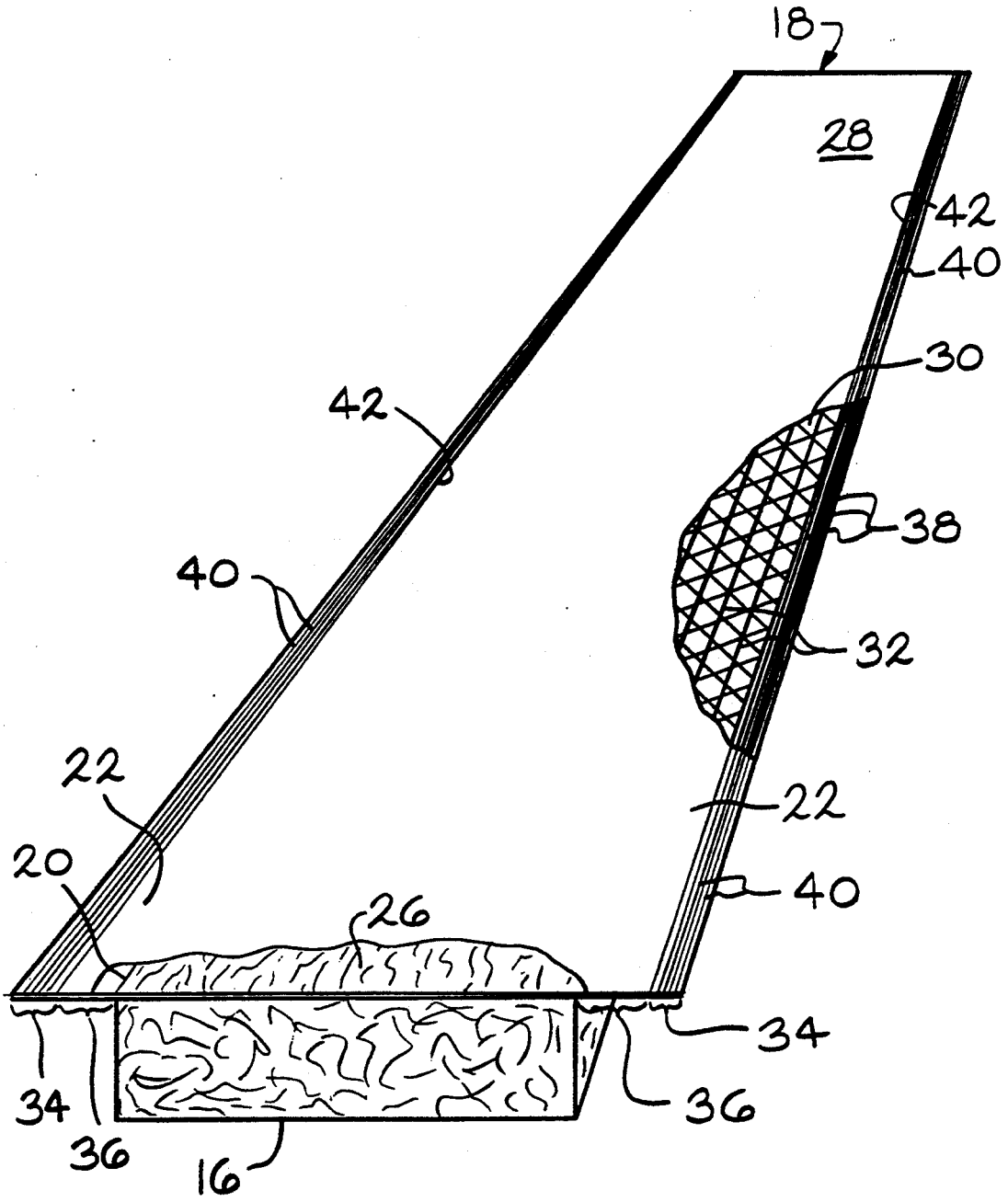
FIG. 2 is a schematic upside-down view in perspective of the insulation product, with portions cut away to show the underlying portions of the product.

Insulation product 14 is generally comprised of blanket 16 and facing 18. As shown in FIG. 2, the facing extends beyond the edges 20 of the blanket to form flanges 22. The flanges are attached to the sides of the joists by any suitable means, such as by staples 24.

The insulation blanket is preferably a light density glass fiber insulation, having an R-value of approximately R-19, although higher or lower thicknesses and R-values can be used. Preferably the density is within the range of 0.3 to 0.9 pounds per cubic foot (PCF). The blanket is elongated, being longer in the machine or longitudinal direction than in the cross-machine direction, as shown in FIG. 2. The cross-machine direction is shown spanning the space between the two joists in FIG. 1.

As shown in FIG. 2, the facing, which is attached to major surface 26 of the insulation blanket, is preferably comprised of three layers. The bottom layer (the layer facing downward in the installed condition as shown in FIG. 1) is foil layer 28. This provides an aesthetically pleasing appearance when viewed from below the ceiling.

The top layer of the laminated facing is a kraft paper layer 30. Sandwiched between the kraft layer and the foil layer is a layer of reinforcement fibers, such as scrim 32. The scrim acts as a general reinforcement for the facing material. A typical scrim has fibers running in the machine direction having a density of about 2 fibers per inch, and fibers in the cross-machine direction having a density of about 3 fibers per inch.

It is to be understood that other types of facing can be used, including plain foil facings, vinyl facings, and other polymer facings. The foil-scrim-kraft facing is commercially available from Lamtec Corporation, Flanders, N.J. as product R-3035 XF. The foil-scrim-kraft product is designed to pass the FS 25 flame spread test defined in the ASTM E84 tunnel test.

As shown in FIG. 2, the opposed flanges can be divided into two imaginary zones, outer edge zones 34 and intermediate zones 36. Extending longitudinally along the outer edge zones of the flanges is a first reinforcement material extending longitudinally along the outer edge zones of the flanges. The first reinforcement material can be any material suitable for reinforcing the flange to accept attachment to the joist. The material can be a film material, such as a polyethylene film, not shown. Alternatively, the first reinforcement material can be a series of first reinforcement fibers, such as polyester reinforcement fibers 38.

An important feature of the reinforcement material is that it provide a contrast with the intermediate zones of the flange so as to give an indication, on each side of the flange, of the boundary between the outer edge zones and the intermediate zones of the flanges. Preferably, the indication is a visual indication so that the installer can easily see where the reinforcement ends and the boundary between the two zones is located. Alternatively, the boundary can be indicated by a tactile indicator so that the installer could easily feel where the boundary is and therefore properly locate the flange for attachment to the joist. It is to be understood that there may be no reinforcement fibers in the intermediate zones, and this would provide the contrast needed to indicate the boundary to the installer.

The first reinforcement material can be any material suitable for providing strength to hold the product when stapled or attached to the side of the joist, such as glass, nylon or polypropylene fibers. Preferably, the first reinforcement material is a series of fibers having a denier of between 840 and 1000.

As shown in FIG. 2, the intermediate zones are provided with second reinforcement fibers, such as scrim. The density of the first reinforcement fibers in the outer zones is relatively high. The density of the longitudinal or machine direction scrim fibers is substantially less than the density of the first reinforcement fibers. Preferably, the ratio of the density of the second reinforcement fibers in the intermediate zones to the density of the first reinforcement fibers in the outer edge zones is less than 0.5. Most preferably, the ratio is less than 0.25. As used in this invention, density is measured by counting the longitudinal fibers per inch in the cross-machine direction.

In one example of the invention, the flange extends approximately 4½ inches beyond the edge of the blanket, and the first reinforcement fibers are placed on approximately ¼ inch centers in the outer edge zones of the flange, the zones being approximately 1¾ inches in width. In this example, the density of the first reinforcement fibers is 4. In contrast, the scrim fibers which may be comprised of fibers running in several directions, are spaced apart at a second spacing substantially greater than ¼ inch, i.e., with ½ inch spacing between parallel strands in the scrim. Therefore, the longitudinal fibers in the scrim have a density of 2. Preferably, the first reinforcement fibers are larger in diameter than the fibers in the scrim, thereby making it easier to see the outline or relief 40 of the first reinforcement fibers through either the bottom (foil) layer of the facing or the top (kraft) layer of the facing. Even though the first reinforcement fibers are applied between the laminations of the foil and kraft layers, their outline can be seen from either side of the flange. Because of the greater thickness and the closer spacing of the first reinforcement fibers in the outer edge zone, the boundary 42 between the outer edge zone and the intermediate zone can be clearly seen by the insulation installer. The installer can then accurately position the flange on the sidewall of the joists by lining up the boundary with the bottom corner 44 of the joist.

It will be evident from the forgoing that various modifications can be made to this invention. Such, however, are considered as being within the scope of the invention.

INDUSTRIAL APPLICABILITY

The insulation product and insulation system of the invention will be found to be useful in insulating the underside of ceilings of commercial buildings, particularly such buildings as warehouses and shipping and receiving rooms.

We claim:

1. An insulation product comprising an elongated blanket of fibrous insulation material having a facing secured on one major surface, the facing extending beyond longitudinal edges of opposite sides of the major surface of said insulation material to form opposed flanges, the flanges having outer edge zones, the flanges having intermediate edge zones positioned inwardly of the outer edge zones, the flanges having a boundary formed between the outer edge zones and the intermediate zones, and the flanges having a first reinforcement material extending longitudinally along the outer edge zones of the flanges for a substantial portion of a width of the outer edge zones and extending up to the boundary, the first reinforcement material along the boundary providing contrast with the intermediate zones so as to provide an indication, on each side of the flange, of the boundary between the outer edge zones and the intermediate zones of the flanges.

2. The insulation product of claim 1 in which the first reinforcement material is a film.

3. The insulation product of claim 2 in which the film provides a visual indication of the boundary on at least one side of the flange.

4. The insulation product of claim 2 in which the film provides a tactile indication of the boundary on at least one side of the flange.

5. The insulation product of claim 1 in which the first reinforcement material comprises first reinforcement fibers.

6. The insulation product of claim 5 in which the intermediate zone contains second reinforcement fibers extending longitudinally, and the ratio of the density of second reinforcement fibers in the intermediate zones to the density of the first reinforcement fibers in the outer edge zones is less than 0.5.

7. The insulation product of claim 6 in which the ratio is less than 0.25.

8. An insulation product comprising an elongated blanket of fibrous insulation material having a facing secured on one major surface, the facing extending beyond longitudinal edges of opposite sides of the major surface of said insulation material to form opposed flanges, the flanges having outer edge zones, the flanges having intermediate edge zones positioned inwardly of the outer edge zones, the flanges having a boundary formed between the outer edge zones and the intermediate zones, and the flanges having first reinforcement fibers extending longitudinally along the outer edge zones of the flanges, the first reinforcement fibers having a first density, and the intermediate zones being provided with second reinforcement fibers having a second density, the ratio of the second density to the first density being less than 0.5 so as to provide a visual indication of the boundary between the outer edge zones and the intermediate zones of the flanges.

9. The insulation product of claim 8 in which the ratio is less than 0.25.

10. The insulation product of claim 8 in which the first reinforcement fibers are larger in diameter than the second reinforcement fibers.

11. The insulation product of claim 8 in which the first density is within the range of from about 10 to about 2 fibers per inch.

12. The insulation product of claim 8 in which the second density is within the range of from about 2 to about 0.5 fibers per inch.

13. The insulation product of claim 8 in which the facing comprises a lamination of two layers with the first reinforcement fibers being sandwiched between them, the first reinforcement fibers being sufficiently large to provide visible relief on both faces of the flanges.

14. An insulation system comprising a series of parallel spaced apart joists and an elongated blanket of fibrous insulation material having a facing secured on one major surface, the facing extending beyond longitudinal edges of opposite sides of the major surface of the insulation material to form opposed flanges, the flanges having outer edge zones, the flanges having intermediate edge zones positioned inwardly of the outer edge zones, the flanges having a boundary formed between the outer edge zones and the intermediate zones, and the flanges having a first reinforcement material extending longitudinally along the outer edge zones of the flanges for a substantial portion of a width of the outer edge zones and extending up to the boundary, the first reinforcement material along the boundary providing a contrast with the intermediate zones so as to provide a visual indication of the boundary between the outer edge zones and the intermediate zones of the flanges, and the flanges being attached to the joists so that the boundary is substantially in alignment with a bottom corner of the joist.

15. The insulation system of claim 14 in which the first reinforcement material is a film.

16. The insulation system of claim 15 in which the film provides a visual indication of the boundary on at least one side of the flange.

17. The insulation system of claim 15 in which the film provides a tactile indication of the boundary on at least one side of the flange.

18. An insulation system comprising a series of parallel spaced apart joists and an elongated blanket of fibrous insulation material having a facing secured on one major surface, the facing extending beyond longitudinal edges of opposite sides of the major surface of the insulation material to form opposed flanges, the flanges having outer edge zones, the flanges having intermediate zones positioned inwardly of the outer edge zones, the flanges having a boundary formed between the outer edge zones and the intermediate zones, and the flanges having first reinforcement fibers extending longitudinally along the outer edge zones of the flanges, the first reinforcement fibers having a first density, the intermediate zones being provided with second reinforcement fibers having a second density, the ratio of the second density to he first density being less than 0.5 so as to provide a visual indication of the boundary between the outer edge zones and the intermediate zones of the flanges, and the flanges being attached to the joists so that the boundary is substantially in alignment with a bottom corner of the joist.

19. The insulation system of claim 18 in which the ratio is less than 0.25.

20. The insulation system of claim 18 in which the flange is attached to the joist by stapling.

21. The insulation system of claim 18 in which the facing comprises a lamination of two layers with the first reinforcement fibers being sandwiched between the two layers, the first reinforcement fibers being sufficiently large to provide visible relief on both faces of the flanges.

* * * * *